US007063161B2

(12) United States Patent
Butler et al.

(10) Patent No.: US 7,063,161 B2
(45) Date of Patent: Jun. 20, 2006

(54) ARTIFICIAL LIFT WITH ADDITIONAL GAS ASSIST

(75) Inventors: Bryan V. Butler, Garrison, TX (US); Rodolfo Ippolito, The woodlands, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 82 days.

(21) Appl. No.: 10/648,814

(22) Filed: Aug. 26, 2003

(65) Prior Publication Data

US 2005/0047926 A1 Mar. 3, 2005

(51) Int. Cl.
*E21B 43/12* (2006.01)

(52) U.S. Cl. ..... 166/372; 166/75.12

(58) Field of Classification Search ..... 166/372, 166/90.1, 369, 75.12, 105.6; 417/151, 182, 417/172

See application file for complete search history.

(56) References Cited

U.S. PATENT DOCUMENTS 3,718,407 A * 2/1973 Newbrough ..... 417/108
3,887,008 A * 6/1975 Canfield ..... 166/267
3,938,738 A * 2/1976 Nagel et al. ..... 239/9
4,020,642 A * 5/1977 Haselden et al. ..... 62/84
4,267,885 A * 5/1981 Sanderford ..... 166/250.01
4,390,061 A * 6/1983 Short ..... 166/53
4,603,735 A * 8/1986 Black ..... 166/68
4,988,389 A * 1/1991 Adamache et al. ..... 166/302
5,055,002 A * 10/1991 Roeder ..... 417/172
5,454,696 A * 10/1995 Wilkinson ..... 417/198
6,007,306 A * 12/1999 Vilagines ..... 417/307
6,146,104 A * 11/2000 Mastroianni et al. ..... 417/54
6,209,641 B1 * 4/2001 Stevenson ..... 166/266
6,382,321 B1 * 5/2002 Bates et al. ..... 166/372
6,457,950 B1 * 10/2002 Cooper et al. ..... 417/366
6,592,334 B1 7/2003 Butler
2003/0085036 A1 5/2003 Curtis et al.
2004/0031622 A1 2/2004 Butler et al.
2004/0129416 A1 * 7/2004 Khomynets ..... 166/105

* cited by examiner

*Primary Examiner*—David Bagnell
*Assistant Examiner*—Daniel P. Stephenson
(74) *Attorney, Agent, or Firm*—Patterson & Sheridan, L.L.P.

(57) ABSTRACT

Well pumping of fluids having low hydrostatic pressure is provided through a combination of jet pumping and gas assisted lifting. A jet pump is located in a borehole in a producing zone of a well, and a source of gas is introduced into the fluid returning from the production location. The gas may be injected into the fluid used to operate the jet pump, such that the gas remains compressed until exiting the jet pump, and then provides assistance in lifting the returning fluid.

4 Claims, 2 Drawing Sheets

ARTIFICIAL LIFT WITH ADDITIONAL GAS ASSIST

BACKGROUND OF THE INVENTION

1. Field of the Invention

Embodiments of the present invention generally relate to the field of fluid extraction from bore holes. More particularly, the present invention relates to artificial lifting devices and methodologies for retrieving fluids, such as crude oil and other liquid hydrocarbons, from bores where the fluid does not have sufficient hydrostatic pressure to rise to the surface of the earth of its own accord.

2. Description of the Related Art

The recovery of fluids such as oil from bore holes is typically accomplished by the pumping of fluid collected in the bore hole by mechanical or fluid power means. These means are necessitated when the pressure of the fluid at the base of the bore hole does not exceed the hydrostatic head needed to cause the fluid to rise to, and over, the earths' surface of its own accord. Several methodologies are known to provide this pumping action, each with its own limitations.

In one methodology, a rod pump repeatedly reciprocates a rod up and down in the casing lining the well at the well head. The rod extends down the well to a production zone, where a pump is located and connected, at its outlet, to production tubing. As the pump downstrokes, the rod pushes a piston in the pump, to force fluids in the piston bore outwardly therefrom and thence into the production tubing. During rod upstroke, a valve closes the connection to the production tubing, and a second valve opens the piston bore to the formation, such that well fluid is drawn into the piston bore. Thus the recovery rate of fluid from the well is dependant upon the stroke of the rod and the number of strokes of the rod per unit of time. The pumps are typically used where the amount of oil to be recovered is marginal, but is sufficient to justify the relatively low cost of this pump arrangement.

A second methodology for artificial lifting uses a down hole positive displacement pump, typically a progressive cavity pump. These pumps typically use an offset helix screw configuration, where the threads of the screw or "rotor" portion are not equal to those of the stationary, or stator portion over the length of the pump, to effect a positive displacement of the fluid through the pump. This requires that the rotating surface of the rotor be sealingly engaged to that of the stator. This is typically accomplished by providing at least the inner bore surface of the stator with a compliant material such as neoprene rubber. The rotor pushes against this compliant material as the rotor rotates, thereby sealing the cavity formed between it and the stator to positively displace fluid through the pump. The rotor is driven by a rod extending down the casing from the surface, and this rod is rotated at relatively low rpm to cause pump operation. One problem associated with this methodology is that these pumps have limited applicability where high temperatures are encountered.

An additional downhole style of pump is the rotary pump, such as a vane or turbine pump, which uses a high speed rotation of an impeller(s) to accelerate fluids and direct them up the bore. Rotation of the impeller(s) is typically accomplished by coupling the impellers(s) to an electric motor which is attached to the impeller(s) downhole. Although it would be desirable to rotate the impeller(s) by a mechanical, surface mounted means, such as a surface mounted motor having a rotateable rod extending down the well bore, this is typically not done, because the speed at which the rod would have to be turned results in "whipping" or other imbalance effects of the rod, causing the relatively long rod to strike the casing or production tubing, eventually rupturing one or both of the rod, tubing and/or casing. Additionally, the durability of the electric motor in the hostile downhole location is limited, and as a result, the motors typically fail after nine months to one year, thereby requiring pulling of the string to retrieve and replace the motor.

A further method of well bore fluid recovery is known as jet pumping. This methodology takes advantage of the venturi effect, whereby the passage of fluid through a venturi causes a pressure drop, and the well fluids being recovered are thereby brought into the fluid stream. To accomplish this in a well, a hollow string is suspended in the casing to the recovery level, and the jet pump is located at the end of the tubing within the production zone of the well. The jet pump includes an inlet, a reduced diameter portion and a flared outlet, thereby forming a venturi. A passage extends between this venturi and the production zone. A fluid under pressure is flowed down the string and through the passages in the pump and thence up to the surface through the annulus between the well casing and the hollow string. The passing of the high pressure fluid through the venturi causes a pressure drop in the high pressure fluid, and thus in the passage to the production zone, thereby causing the production fluids to be pulled into the stream of high pressure fluid passing through the pump and thus carried to the surface therewith. Preferably, the fluid being used for recovery is of the same species as that being recovered. Thus, excess returns of fluid are recovered, and the remaining fluid is recycled and again directed down the well. This technique suffers from limited fluid recovery rate and the need for extensive equipment, the cost of which typically exceeds the value of the oil which may be recovered, which would be acceptable if the recovery rate were greater.

An additional method of well bore fluid recovery is gas-assisted lifting, in which a gas is injected into the fluid to be recovered. The injected gas forms bubbles in the fluid. These bubbles rise to the surface and propel well fluids upwardly therewith. This technique likewise suffers from limited fluid recovery and the need for extensive equipment, the cost of which typically exceeds the value of the oil which may be recovered.

Therefore, there exists in the art a need to provide enhanced artificial lifting methods, techniques and apparatus, having a greater return on investment and or durability.

SUMMARY OF THE INVENTION

The present invention generally provides methods, apparatus and articles for the improved artificial lifting of fluids, using a pump having enhanced fluid lifting capability from the well bore.

In one embodiment, the invention provides a pumping member locatable in a production zone of a well, and a secondary lift mechanism, simultaneously present in the well bore to enhance artificial lifting of well fluids. Preferably, the secondary lift mechanism is a gas injected into a liquid, whereby the gas forms gas bubbles in the well fluid and enhances the buoyancy thereof for recovery of the fluid.

In a further embodiment, the invention provides a jet pump, positioned within a well bore at a fluid production location, and the fluid passing through the jet pump and thereby providing the suction of the well bore fluids into the fluid stream further includes a material dissolved therein which provides additional lift to the fluid as it is carried up the bore. Preferably, this material is a material which is inserted at the well head under pressure into a pressurized stream of pumping fluid to be passed through the jet pump, which material becomes gaseous after leaving the jet pump and thereby provides additional lifting capability to the returning stream of pumping fluid and well bore fluid.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
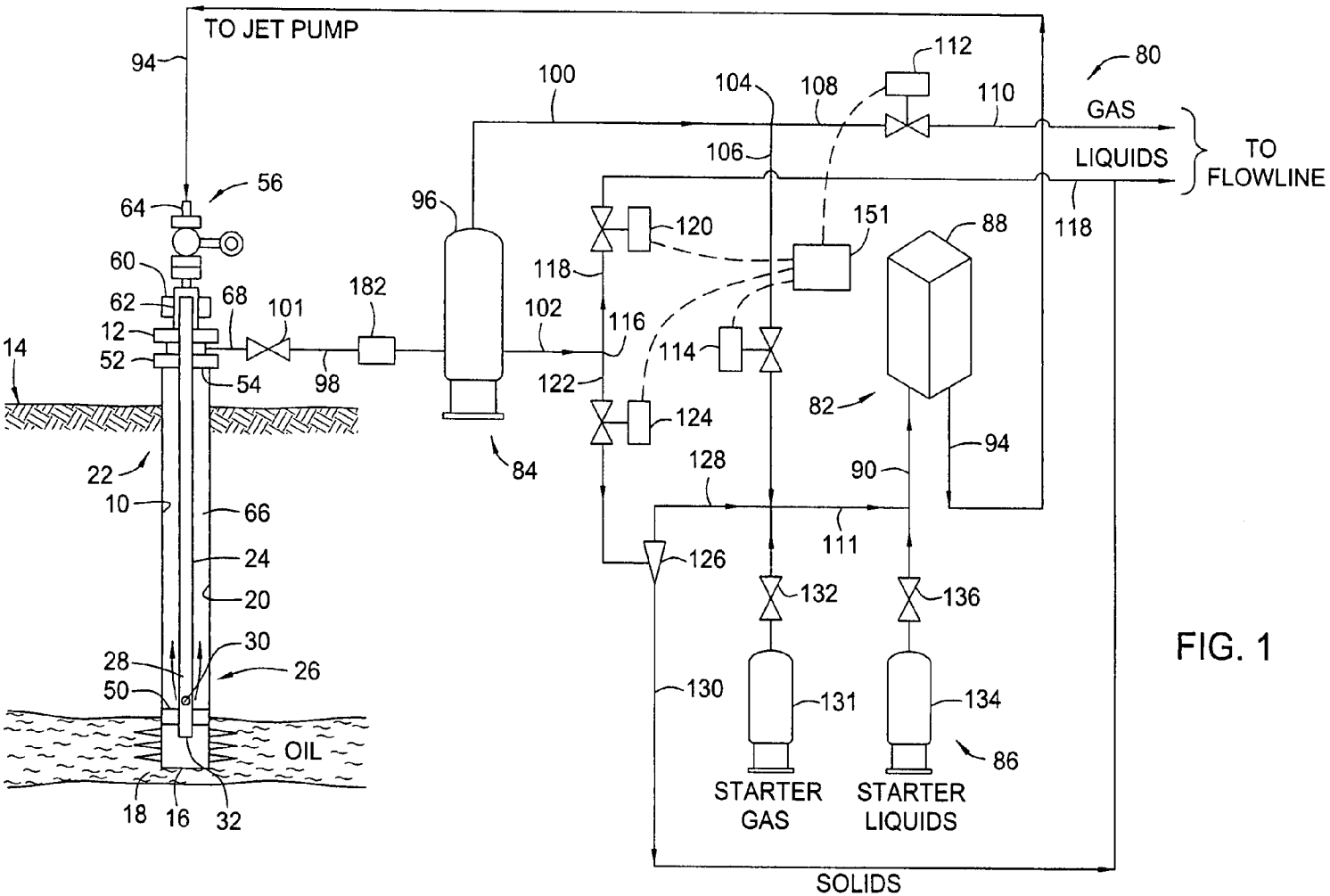
FIG. 1 is a schematic view of a borehole, down hole equipment and adjacent well head peripherals used to provide the gas assisted artificial lifting of the present invention.

Referring to FIG. 1, there is shown, in schematic representation, a producing oil well having a first borehole 10 extending from a well head 12 at the opening of the borehole to the surface 14, and a lower terminus 16, in a production zone 18. Multiple such production zones may be traversed by the borehole. The well bore is cased, i.e., casing 20 extends along the borehole 10 to isolate the earth formation 22 around the borehole 10 from exposure to any tools or materials present in borehole 10.

Extending into production zone 18, and suspended on the end of a hollow tube 24, is a jet pump 26. As will be explained further herein, jet pump 26 includes an inlet section 32 extending into fluid communication with the fluids in the production zone 18, a pumping liquid inlet 30 in fluid communication with the interior of hollow tube 24 (shown in FIG. 2) and an outlet 28 in fluid communication with the cased portion of the borehole 10. The fluid exiting the outlet 28 flows upwardly in the borehole 10 in the space or annulus 66 between the hollow tube 24 and the casing 20 in the wellbore 10, to the earths' surface.

Referring still to FIG. 1, well head 12 is positioned at the opening of the well at the surface of the earth, and generally includes at least a first portion 52 in sealing (typically welded or flange clamped) to the upper terminus 54 of casing 20, and an upper portion 56 including valving and other apparatus as will be further described herein. First portion 52 also includes a valved return outlet 68 therein, through which material moving upwardly in the annulus 66 between the casing 20 and the hollow tube 24 can be recovered. Upper portion 56 includes a hanger 60, from which the upper terminus 62 of hollow tube 24 is suspended, such as by being welded or clamped therein, and an upper valved inlet 64, preferably collinear with the centerline of the hollow tube 24, through which pumping liquid is injected into the well though hollow tube 24. Thus, pumping fluid may be injected in a flow controlled mode, through throttling thereof by the valved inlet 64, at a high pressure to pass through the jet pump 26 where well fluids are pulled from the production region 18 and then returned through the annulus 66 to valved return outlet 68 where the well fluid can be recovered and the pumping fluid separated therefrom and reused.

As also shown in FIG. 1, the separation of well fluids and recovery of the pumping fluid is accomplished by fluid control system 80 located generally adjacent to wellhead 12. The fluid control system 80 is configured to enable recirculation of the fluids returned from the wellbore 10 until a desired return of wellbore fluids is achieved, and thereafter either or both of the introduced gas, as well as the recovered wellbore fluids may be recovered from the well and distributed from the system.

Thus, fluid control system 80 includes a high pressure system 82, which supplies fluid under pressure to the jet pump 26, a return system 84, which receives fluid returning from the wellbore through return outlet 68 and selectively separated, where necessary and proper, and start up system 86 which is used, in conjunction with high pressure system 82, to initiate pumping from the wellbore 10.

Referring still to FIG. 1, high pressure system 82 generally includes multiphase pump 88, a fluid inlet 90, through which a relatively low pressure stream of a mixture of gas and liquid is conveyed into the low pressure, or entry, side of multiphase pump 88, and a high pressure outlet line 94 extending from multiphase pump high pressure outlet to the end of hollow tube 24 extending upwardly through the wellhead 12. Multiphase pump 88 is capable of receiving a mixture of a liquid and a gas, and simultaneously pressurizing them, such that the fluid pressure in the exit of the pump may be sufficiently high to dissolve the gas into the liquid.

After the high pressure fluid is passed through the hollow tube 24, jet pump 26 and then upwardly in the annulus 66 between the casing 20 and the hollow tube 24, it exits the return outlet 68 and enters return system 84. Return system 84 provides separation of well fluids from the high pressure pumping fluid, as well as valving and control circuitry to determine the proper routing of the fluids returning from the well. As shown in FIG. 1, a separator 96 is fed returning fluid through return conduit 98, which is selectively opened, closed or throttled by return valve 101 located in fluid communication with return outlet 68. Separator 96 separates gas in the returning fluid from liquids, such that gas is supplied therefrom to return gas line 100, and fluid is supplied therefrom to return liquid line 102. Return gas line 100 extends from separator 96 to a tee or junction 104, having a recycle gas line 106, and a production gas outlet 108 extending therefrom. Gas entering production gas outlet 108 may be fed to a gas flowline 110, or throttled or prevented from entering gas flowline 110, by gas outlet valve 112. Gas entering gas recycle line 106 will return to a pump low pressure inlet line 111 ported to the low pressure inlet 92 of the multiphase pump 88 through fluid inlet 90, unless throttled or restricted therefrom by gas recycle line valve 114. Thus, to divert gas for production from the well, gas recycle line valve 114 is closed and gas outlet valve 112 is opened. Contrary settings of these valves will divert the gas recovered from separator 96 to multiphase pump inlet line 90, for re-injection into the well. Furthermore, it is contemplated that intermediate valve settings may be used, such that some gas is recovered through flowline 110, while some is returned to the inlet line 90 of multiphase pump for re-injection into the well.

Liquid separated from the returning fluid recovered from the well passes into return line 102, and is likewise fed to a tee or junction 116, having a production side outlet 118 which is controlled by liquid production valve 120, and a liquid recycle line 122, the access to which is controlled by liquid recycle valve 124. Each of liquid recycle valve 124 and liquid production valve 120, as well as gas outlet valve 112 and gas recycle valve 114, are electronically controlled, such as by a microprocessor controller or computer 151, which controls their state of open, close or throttling as will be hereinafter described. To prevent backflow of fluids in the return lines 100, 102 and pump inlet lines 106, 128, as well as the possibility of gas flowing in a reverse direction in the liquid lines or liquid flowing in a reverse direction in the gas lines, each of at least lines 100, 102k 106 and 128 include one way valves (not shown) therein, such as check valves, which prevent rearward flow of fluids therepast, but allow forward flow of fluids therepast.

Liquid which is passed through liquid recycle valve 124 and is thus directed to be re-injected into the well enters cyclone 126, which separates solids from the liquid stream. Sand, as well as other production region solids, as well as accumulated mud or other impurities in the casing, will typically be returned from the wellbore through return outlet 68, and should be separated from any recycled liquids before such liquids enter the multiphase pump 88. Thus, cyclone 126 has extending therefrom recycle liquid pump return line 128, through which recycled liquid from the borehole is returned to the low pressure inlet through inlet line 90 of multiphase pump 88, as well as a solid return line 130, which is configured for removal or conveyance of solids from the system, it being understood that the solids may be carried in a fluid stream upon exit from the cyclone 126. As shown in FIG. 1, this solid material is shown as returning to the liquid production flowline 118 downstream of valve 120, although other disposal regimens are specifically possible.

Referring still to FIG. 1, start up system 86 generally includes a gas supply 131 selectively communicable with low pressure inlet line 111 through gas supply valve 132, and a liquid supply 134, selectively communicable with the low pressure pump inlet line 111, through fluid supply valve 136. Each of valves 132 and 136 are also preferably controlled by computer 151. Each of gas supply 131 and liquid supply 134 preferably supply their contents under sufficient pressure to supply useable quantities thereof to the inlet 90 of multiphase pump 82. Although supplies 131, 134 may be large reservoirs of liquid and or multiple tanks of gas, as the case may be, they may also be supplied by a pipe connection to sources of liquid and gas. Further, the liquid is preferably crude oil or other liquid hydrocarbon found in the well being exploited, and, where natural gas is present in the well, the gas is likewise preferably natural gas.

Figure 2:
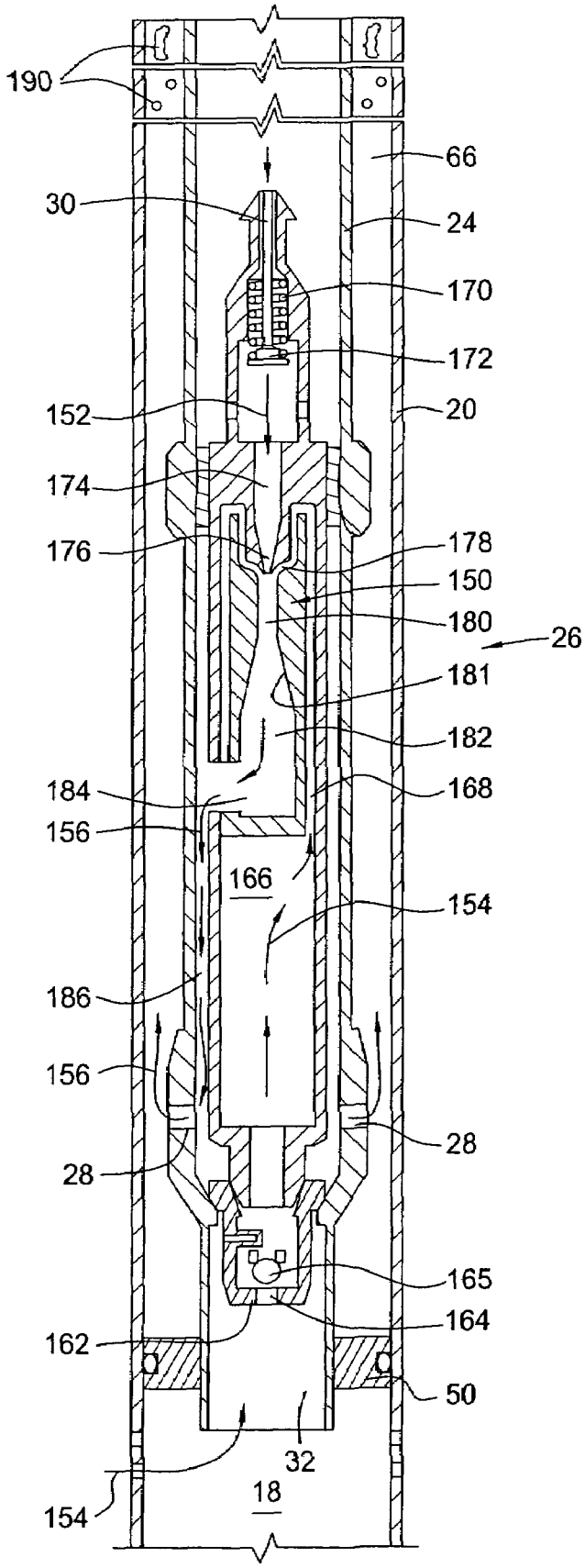
FIG. 2 is a sectional view of a jet pump located in a producing zone of a well bore.

Referring now to FIG. 2, jet pump 26 is located on the end of hollow tube 24 and landed on packer 50. Jet pump 26 is configured to receive a flow of high pressure fluid therein, from a remote, non-production zone source, in this embodiment the multiphase pump 88 and accompanying tubing, and pass that high pressure fluid through an expansion nozzle, thereby resulting in a reduced pressure at the restriction point of the nozzle. By allowing the relatively low fluid pressure well fluid in the production zone to be introduced to the stream of high pressure fluid flowing through the pump 26 at this restriction point, the well fluids will experience a pressure drop at that location and thus flow into the stream of high pressure fluid passing through the pump 26. The fluid velocity and pressure exiting the pump 26 is still sufficient to lift the fluids leaving the pump to the earths' surface 14.

Jet pump 26 generally includes a well fluid inlet region 32, a high pressure pumping fluid inlet 30, a venturi section 150 into which both the high pressure pumping fluids flow, as shown by arrows 152, and well fluids flow, as shown by arrows 154. The combined well fluid/pumping fluid return stream then exits the pump 26 in a path shown by arrows 156, to return to the earths' surface 14 (FIG. 1) by flowing out of pump exit 28 and then upwardly in annulus 66.

Referring still to FIG. 2, well fluid inlet 32 is extended into production zone 18 of the well, at least co-terminus or extending beyond the lowermost surface of packer 50. Fluid inlet extends inwardly of the housing or body of pump 26, to an entry check valve 162, having an entry fluid passage 164 therethrough selectively blockable by a ball 165 when pressure in the well fluid inlet 32 is less than that in the pump 26. Fluid inlet then extends into a reservoir region 166, from which fluid is pulled by venturi section 150 through an annular passage 168 extending from the reservoir 166 to the venturi section 150.

Pumping fluid inlet 30 generally includes a valved fluid passage 170 extending in fluid communication between the interior of tube 24 through which high pressure pumping fluid is introduced to the pump 26, and the venturi section 150. Passage of fluid through valved fluid passage 170 is controllable by a spring loaded poppet valve 172, which is spring biased in a direction to close valved fluid passage 170 in the event that the pressure in the tube 24 drops below a pre-selected pressure, to prevent well fluid from passing outwardly of the pump 26 through the valved fluid passage 170.

Venturi 150 includes a tapered inlet 174, through which the high-pressure pumping fluids enter the venturi 150 and which ends in an orifice 176. Adjacent and preferably surrounding the orifice 176 at the exit of the orifice is an annular well fluid passage 178 in fluid communication through annulus 168 with well fluids to be pumped from the well, and a generally right cylindrical throat 180 extending co-linearly with the inlet 174 and in fluid communication with orifice 176 and annular well fluid passage 178. Throat 180 extends to a flared outlet 181 having a generally expanding diameter as it extends from throat 180, which then extends into outlet reservoir 182. Outlet reservoir 182 has an outlet 184 therefrom to direct the fluid leaving the venturi 150 into a pump production annulus 186 and thence to pump outlets 28 (as shown by arrows 156) in fluid communication with annulus 66 to enable the fluid exiting the pump 26 to pass to the earths' surface 14.

As high pressure fluid is passed through the orifice 176 and thus through the throat 180 and flared outlet 181 of the venturi 150, a pressure drop occurs at the annular well fluid passage 178, thus pulling well fluids existing at the passage 178 to flow into the stream of pumping fluid passing into throat 180, and thence out of the pump and to the earth's surface 14. Additionally, as the high pressure fluid travels to the earth's surface 14, the gas in the fluid will form bubbles 190 as it comes out of solution, to aid in the return of the combined high pressure fluid stream to the earth's surface 14 and thus recovery of the well fluids by the control system 80.

Referring again to FIG. 1, operation of the control system 80 of the present invention will be described. At start up, recoverable well fluids, preferably liquid or gaseous hydrocarbons, will be present in the production zone 18 of wellbore 10. To initiate the pumping of these well fluids, the jet pump 26 will be initially operated in a fluid only, i.e., a non-gas injected, mode. To accomplish this, fluid, typically in the form of crude oil as exists at the production zone 18, is continuously supplied from liquid supply 134 to the inlet 90 of the multiphase pump 82, whereby a high pressure well pumping fluid is sent through high pressure outlet 94 and thus into hollow tube 24 where such high pressure fluid enters the inlet 30 of jet pump 26. The high pressure fluid passes through the pump 26 as previously described, pulling some of the well fluids into the stream of high pressure pumping fluid passing through the pump, and thence the combined fluids are returned to the control system 80 through annulus 66 and associate surface piping or lines. Once the hollow tube 24 and the return annulus 66 between the casing 20 and hollow tube 24 are filled with pumping fluid, the gas supply inlet valve 132 is opened, and gas is mixed with the pumping fluid and compressed in the multiphase pump 88, such that the gas is dissolved in the liquid when it enters the hollow tube 24 with the high pressure pumping fluid. At this time the pumping rate is increased to increase the volumetric flow of pumping fluid entering the hollow tube 24.

As the high pressure well pumping fluid travels to the earth's surface 14, carrying well fluid therewith, the pressure drop experienced by the high pressure pumping fluid as it travels to the earth's surface 14 causes the pressure in the exiting fluid to be below that at which the gas can remain in a liquid or solution phase, and the gas thus forms the bubbles 190 which will assist in the lifting of the returning combined fluid stream. When the combined stream of well pumping fluid, bubbles and well fluid reaches the separator 96, the gaseous portion is passed therefrom to the multiphase pump 88, routed through gas line 100, through return valve 114, with flowline valve 112 closed. Likewise, fluid recovered from separator 96 is returned to multiphase pump 88, flowing through valve 124, it being understood that valve 120 is closed, thereby preventing release of the returning fluid to the flowline. Thus the gas and well pumping fluid are both initially re-pressurized and recycled down the well. At this point, additional liquid or gas from startup system may not be required, and if this is the case, then one or both of valves 132, 136 may be closed, as the situation dictates.

The flow of fluid returning through outlet 68 is monitored by virtue of a flow meter 182, preferably a flow meter readable by computer 150, to determine an optimum flow rate for returned fluids as compared to injected fluids. Such optimum is a function of the diameter of the hollow tube 24 and casing 20 (and thus the size of the annulus), and the jet pump rating. Such optimum flow rate contemplates the optimal additional return fluid, i.e., well fluid added to the fluid pumped down the bore, for the sizing of the equipment and energy required to operate same, at which point fluid recovery should begin. With such information, one skilled in the art can calculate a likely optimum flow for the system.

Once the flow rate of return of well fluid and well pumping fluid has reached an optimum condition, the liquid return valve 124 is throttled to a restricted condition, and the liquid flowline valve 120 is opened to a throttled open condition, to allow fluid in excess of that being pumped down the well, i.e., produced fluid, to pass into flowline for supply to a pipeline or reservoir. Likewise, where natural gas is returned from the well, gas recycle valve 114 is throttled to a restricted position while gas flowline valve 112 is opened to a restricted position, to allow excess gas recovered from the well to be sent down the flowline 110 for ultimate recovery. Preferably, flow meters readable by computer 151 are also disposed in flow lines 110,118, and in recycle liquid line 128 and recycle gas line 106, as is the flow meter on return line 98 and high pressure outlet line 94, so that computer 151 can monitor, in real time, the flows through the various lines, and ensure that the portions of gas and liquid which are sent into flow lines 110, 118, do not exceed the excess fluid volume of each component returning from the wellbore 10.

The use of gas in addition to the liquid flow through the jet pump significantly increases the lifting capability of the pump, providing greater efficiency of pumping.

While the invention has been described with specific reference to mixing of the gas and liquid in a multiphase pump, other means, such as injection of the gas in liquid form into the high pressure stream, or injection of the gas through a tube and thus into the well bore adjacent to the pump outlet or otherwise in the inlet stream is specifically contemplated.

While the foregoing is directed to embodiments of the present invention, other and further embodiments of the invention may be devised without departing from the basic scope thereof, and the scope thereof is determined by the claims that follow.

The invention claimed is:

1. A system for pumping a production fluid from a wellbore, comprising:

a high pressure multiphase pump coupled to an outlet line and operable to pressurize a first mixture of a liquid and a gas so that at least a portion of the gas dissolves in the liquid;

a jet pump:

disposed in the wellbore proximate to a formation, coupled to the outlet line so that the second pump may receive the pressurized first mixture, having an inlet for receiving the production fluid, and operable to throttle the first mixture, thereby drawing the production fluid into the inlet, forming a second mixture comprising the first mixture and the production fluid, and allowing at least a portion of the dissolved gas to escape from the solution as the second mixture rises to a surface of the wellbore, thereby lowering a pressure gradient of the second mixture to increase a production rate of the production fluid;

a wellhead sealing the surface of the wellbore;

a return line coupled to the wellbore so that the return line receives the second mixture;

a separator coupled to the return line and operable to deliver a gas portion of the second mixture to a gas return line and a liquid portion of the second mixture to a liquid return line;

a gas production line having a control valve and coupled to the gas return line;

a gas recycle line coupled to an inlet line of the multiphase pump and the gas return line and having a control valve;

a liquid production line having a control valve and coupled to the liquid return line;

a liquid recycle line coupled to an inlet line of the multiphase pump and the liquid return line and having a control valve, and a computer operable to deliver a first portion of the gas portion to the gas production line, a second portion of the gas portion to the gas recycle line, a first portion of the liquid portion to the liquid production line, and a second portion of the liquid portion to the liquid recycle line by controlling the control valves.

2. The system of claim 1, wherein the liquid is crude oil and the gas is natural gas.

3. The system of claim 1, further comprising a liquid and a gas reservoir coupled to an inlet line of the multiphase pump for start-up of the multiphase pump.

4. The system of claim 1, wherein the wellbore is cased and an outlet of the jet pump is in fluid communication with an annulus between the casing and the outlet line.

* * * * *

UNITED STATES PATENT AND TRADEMARK OFFICE

CERTIFICATE OF CORRECTION

PATENT NO. : 7,063,161 B2
APPLICATION NO. : 10/648814
DATED : June 20, 2006
INVENTOR(S) : Bryan V. Butler and Rodolfo Ippolito It is certified that error appears in the above-identified patent and that said Letters Patent is hereby corrected as shown below:

In column 8, Claim 1, line 25, please delete “second” and insert --jet--.

In column 8, Claim 1, line 26, at the end of the line after “mixture,”, please insert --and--.

In column 8, Claim 1, line 32, please delete “solution” and insert --second mixture--.

In column 8, Claim 1, line 37, between “sealing” and “surface”, please delete “the” and insert --a--.

In column 8, Claim 1, line 49, between “to” and “inlet”, please delete “an” and insert --the--.

In column 8, Claim 1, line 51, between “valve” and “and”, please delete the comma “,”, and insert a semicolon --;--

In column 8, Claim 3, line 61, between “to” and “inlet”, please delete “an” and insert --the--.

Signed and Sealed this

Third Day of April, 2007

JON W. DUDAS
*Director of the United States Patent and Trademark Office*